US011027798B2

(12) United States Patent
Pompor

(10) Patent No.: US 11,027,798 B2
(45) Date of Patent: Jun. 8, 2021

(54) TO CONNECT FLOAT MODULES TO EACH OTHER AND/OR TO AN ASSEMBLY AND/OR TO A SUPERSTRUCTURE MOUNTED ONTO THEM, FOR PONTOONS CONSTRUCTED OF FLOAT MODULES

(71) Applicant: Gyula Pompor, Budapest (HU)

(72) Inventor: Gyula Pompor, Budapest (HU)

( * ) Notice: Subject to any disclaimer, the term of this patent is extended or adjusted under 35 U.S.C. 154(b) by 178 days.

(21) Appl. No.: 15/780,816

(22) PCT Filed: Dec. 2, 2016

(86) PCT No.: PCT/HU2016/000076
§ 371 (c)(1),
(2) Date: Jun. 1, 2018

(87) PCT Pub. No.: WO2017/093772
PCT Pub. Date: Jun. 8, 2017

(65) Prior Publication Data

US 2020/0001950 A1 Jan. 2, 2020

(30) Foreign Application Priority Data

Dec. 4, 2015 (HU) ..... P1500595

(51) Int. Cl.
*B63B 35/44* (2006.01)
*B63B 35/38* (2006.01)
*E02B 3/06* (2006.01)

(52) U.S. Cl.
CPC ..... *B63B 35/38* (2013.01); *E02B 3/064* (2013.01); *B63B 2231/60* (2013.01)

(58) Field of Classification Search
CPC ..... B63B 35/00; B63B 35/003; B63B 35/34; B63B 35/58; B63B 2231/60;
(Continued)

(56) References Cited

U.S. PATENT DOCUMENTS 2,480,144 A * 8/1949 Johnn ..... B63B 35/38 114/266
2,527,995 A * 10/1950 Hamilton ..... B63B 35/52 14/27
(Continued)

FOREIGN PATENT DOCUMENTS

FR 2597826 A1 10/1987
GB 2068847 A 8/1981
(Continued)

*Primary Examiner* — Daniel V Venne

(57) ABSTRACT

In summation, the invention is a design to connect float modules (2) to each other and/or to assembly units and/or to the superstructure. In a preferred embodiment, the invention is applied for pontoons (1) constructed of concrete float modules (2), where prismatic float modules (2) minimally include a monolithic upper plate (3), side walls (4) and/or frame units (6) arranged along the edges (5) of the float module (2) and float modules (2) are fixed to each other by means of longitudinal tension units (15) led through said float modules (2). For tension units (15), boreholes (8) are created in the side walls (4) or the frame units (6) of the float module (2) minimum at the edges (5) of the upper plate of the prism, intersecting the prism and running parallel with the edges (5). In particular cases, directional recesses (14) are created around the exit holes (9) of boreholes (8) with skew axes (Tx, Ty, Tz), running in different directions and meeting in the corners of float modules (2). Into the directional recesses (14) between the float modules (2), resilient directional spacers (16) are inserted. Directional spacers (16) have boreholes that contain the relevant tension units (15). In present invention, at least the surfaces with the boreholes (8) for the tension units (15) are equipped with rigid corner elements (11) at the corners of the float module (2) where the impact resistance and compressive strength of the material of the corner elements (11) exceed those of the material of the float module (2); boreholes (13) are created
(Continued)

for the exit holes (9) in the corner elements (11); the directional recesses (14) sunk into corner elements (11) are shaped as truncated cones tapering inwards and the envelope of directional spacers (16) has the same shape as that of the directional recess (14), two truncated cones with their bases facing each other.

10 Claims, 16 Drawing Sheets

(58) Field of Classification Search
CPC ..... B63B 2231/62; E01D 15/00; E01D 15/14; E01D 15/145; E01D 15/24; B63C 1/02; E02B 3/064
USPC .... 114/45, 65 R, 65 A, 77 R, 77 A, 85, 258, 114/263, 264, 266, 267, 292, 343, 352
See application file for complete search history.

(56) References Cited

U.S. PATENT DOCUMENTS 3,091,203 A * 5/1963 Usab ..... E02B 3/064 114/266
3,448,709 A * 6/1969 Hardwick, Jr. ..... E02B 3/064 114/266
3,788,254 A 1/1974 Sheil
5,107,785 A * 4/1992 Baxter ..... B63B 35/34 114/266
5,192,161 A * 3/1993 Helgesson ..... B63B 35/34 405/26
6,199,502 B1 * 3/2001 Mattson ..... B63B 5/18 114/266
7,762,205 B1 * 7/2010 Veazey ..... B63B 3/08 114/267
2005/0103250 A1 * 5/2005 Thomson ..... B63B 5/14 114/266
2007/0144424 A1 * 6/2007 Strong ..... E02B 3/064 114/266
2007/0283866 A1 * 12/2007 Veazey ..... B63B 3/08 114/77 R
2009/0304448 A1 * 12/2009 Ovretveit ..... B63B 35/38 405/26
2010/0124461 A1 5/2010 Danskine
2011/0132250 A1 * 6/2011 Nelson ..... E04H 1/04 114/266

FOREIGN PATENT DOCUMENTS

JP 2014001583 A 1/2014
KR 101419188 B1 7/2014

* cited by examiner

TO CONNECT FLOAT MODULES TO EACH OTHER AND/OR TO AN ASSEMBLY AND/OR TO A SUPERSTRUCTURE MOUNTED ONTO THEM, FOR PONTOONS CONSTRUCTED OF FLOAT MODULES

BACKGROUND OF THE INVENTION

Field of the Invention

The invention relates to a structure according to the claimed invention for connecting float modules to each other or to an assembly unit or to a superstructure mounted onto them, for pontoons constructed of float modules.

As known, pontoons are widely used as ports, piers and similar structures attached to banks and shores or floating near the coast. Larger pontoons are constructed of float modules. Such float modules are made of various materials such as metal, wood, plastic or concrete.

Geometrically, concrete float modules are usually considered as prisms, although pontoon sets other than these are also used. In the case of prismatic float modules, the upper plate bears the load and this upper plate is supported by at least two side walls facing each other or connected side walls arranged in a circle. The walls of float modules are relatively thin; however, wall thickness is typically increased at the edges where side walls meet each other or the upper plate and also at the lower (free) edges, thus creating reinforced frame units. The interior space of the float module is filled with plastic foam.

Pontoons are constructed by connecting such float modules. Connecting concrete float modules is different from the method used in the case of other materials, because as well known, the strength of concrete widely varies with the various loading directions and its compressive strength significantly exceeds its tensile strength or flexural strength. Accordingly, connecting concrete float modules should rely on compression. Connecting may be performed in various ways.

Brief Description of the Related Art

Although the criteria explained in the previous sections are generally observed in KR 101419188, it describes a different solution. The solution applies to cubical float modules that are essentially constructed from cube shaped frame units. Side and bottom elements facilitating floating are only added after assembly of the frame. Float modules arranged side by side are fixed to each other by screws inserted into the boreholes in the neighbouring frame units.

In the solution described in U.S. Pat. No. 5,107,785, the previously explained criterion is indeed applied. Accordingly, the float modules, being constructed one after the other; contain inbuilt pipes running parallel with all the four edges along the direction of the units following each other. In these pipes, longitudinal tension units—bars or cables—are run. Float modules arranged side by side are kept together by means of nuts tightened on both ends of tension units. If a wider field is needed, several rows of float modules may be constructed side by side. In this particular case, further pipes are installed in the units, perpendicular to the aforementioned ones. The inner diameter of pipes is twice as much as the diameter of the tension unit; hence tension bars or cables have enough space above each other where the pipes meet. The solution described in US 20100124461 is essentially similar.

U.S. Pat. No. 6,199,502 discloses a solution where tension units connecting float modules are run in grooves created on the side walls of float modules. The grooves on opposite sides are at the same plane; the two pairs of grooves are in different planes. The sides of the modules are concaved to allow the modules to fit securely together. The float module set includes both square and triangular based modules.

While in the solutions described above modules are directly connected to each other, in the solution disclosed in US 20050103250 neighbouring float modules are connected by tension units that run parallel with their four longitudinal edges and tension units between float modules are equipped with plate-like resilient pads. If the float modules are used to construct pontoons that cross each other, perpendicular tension units are built into said modules in different planes.

In U.S. Pat. No. 3,788,254, resilient pads are also placed between float modules. In this solution, float modules are only connected by one pair of tension units. These, however, are not run in walls parallel to them but left free between the opposite walls of float modules. Accordingly, opposite walls are reinforced around the tension units. Transversally, tension units are run in the aforementioned reinforcement and the pads are inserted between the edges of float modules.

US 20090304448 also describes a solution where float modules are connected by tension elements run near their upper edges on the one hand and parabolically in their side walls on the other hand. Neighbouring float modules are connected side by side with their closed side walls facing each other. Recesses are made in these walls, one in each, facing each other, and resilient pads are inserted into them. Tension units are not led through these resilient pads. Instead, a given pad is fixed on one float module by screw and allowed to shift in the other recess vertically to its axis in any direction.

U.S. Pat. No. 5,192,161 describes a solution where float modules are fitted with tension units only at their upper planes. In the sides of float modules facing each other, cylindrical recesses are formed around tension units and into these, resilient cylindrical pads are inserted. These pads are longer than the combined depth of the two recesses. Hence, when float modules are pulled to each other, pads will fill the cylindrical recess on the one hand and bulge out in the middle, forming a resilient block maintaining the margin between modules on the other hand, thus preventing float modules from grinding against each other.

The solution described in GB 2068847 is similar, differing from the previously explained solution in the arrangement of tension units as these are run through the middle of the sides of float modules facing each other. Boreholes are surrounded by cylindrical recesses. Into these recesses, rubber pads are inserted. Although these pads are longer than the combined depth of the recesses, spacers fixed along the upper edge of side walls prevent their distortion at collision.

U.S. Pat. No. 3,091,203 also describes a design where tension units lie in the top plane of the float modules, with a small flange created around the top edges of the float modules. The float modules are joined through the flanges, using tensioning rods led beneath the plane of the top face or in protective pipes built into the flanges. On the side surface of the flanges, along their entire length or in the recesses around the tensioning rods, resilient elements and directional discs are inserted. The two ends of the tensioning rods are tightened with nuts, which rest on the resilient directional discs also inserted into these recesses, with washers between them. Connection via the small flanges and the tension units running solely beneath the upper surfaces of the modules prevent construction of a unitary load-bearing assembly unit, at higher loads of occupying more than one float module the modules can collapse because of the uneven load forces.

In a pontoon built of the module system described in FR 2597826, in the sides of the float module constructed of sheets and filled with foam there are inward-tapering grooves with a trapezoidal cross-section, running along their entire length, in one version, and pyramidal recesses in the other version. There are boreholes at the bottom of the grooves/recesses. The corresponding boreholes in the two opposite sides are connected through pipes. To join the float modules, pegs with a double trapezoidal cross-section are inserted into adjacent grooves, and pads of the same shape, secured to the two sides of a longitudinal connecting element, are inserted into the pyramidal recesses. The float modules are joined using tensioning rods led through the pipes and pegs or through the pads. The float modules have a single position and assemblage possibility that makes building assemblies of different form and load bearing capability due to the different form and dimension of the used float modules impossible. The float modules can be assembled side by side in one direction because the spars used do not allow an assembly unit in cross direction.

The technical solutions detailed above are characterized by several problems that adversely impact the strength and stability of the pontoon and/or the float modules.

As explained in the introduction, the tensile strength and flexural strength of concrete are low, at least compared to its compressive strength, thus connecting float modules by screwing their neighbouring walls together provides for a much weaker connection than using tension units that are led through the float modules. However, side walls are subject to unwanted flexural stress, if tension units or directional units are fixed at such points on side walls that are not properly supported from the other side by side walls.

In the case of solutions where float modules are not separated by spacers or where the diameter of resilient pads is smaller than that of the recesses and thus no directional force is exerted and the diameter of the tension unit is smaller than the pipe hosting it, the relative position of float modules is not controlled and their motion is only slowed down by friction. At the same time, tension units are subjected to shear stress.

Where tension units are fixed in one plane and in particular where this plane is represented by the upper plates of float modules, waves or loading the platform will result in the lower part of the modules disengaging and then clashing again, destroying the system. In this case, if the distance between the side walls of float modules is maintained by spacers or bulging rubber pads, the angle between float modules, i.e., the relative position of modules may change and it is impossible to create a rigid, uniform platform.

If tension units are run in external grooves, keeping these tension units in the desired position represents further problems. Accordingly, installing such tension units is difficult and they may be displaced while in operation.

Finally, a common characteristic of known inventions is that the section of a float module sunk in water and that staying above water are distinguished and these are not interchangeable. Accordingly, such float modules can float in the water in one position only, so there are only two ways to connect them: they are either connected by their short or long sides. A further disadvantage of said inventions is that the load bearing capacity of the modular systems created from them may only be increased by also increasing the surface of water occupied by the structure. Another adverse feature is their relatively large size and weight which render their transport and installation in water difficult and expensive.

The aim of the present invention is to eliminate these drawbacks by means of developing a connecting arrangement that, in a preferred embodiment, facilitates the construction of a pontoon of float modules made of concrete and filled with plastic foam in a way that the area, dimensions and shape of said pontoon are easily modified in all three directions of space.

It is further necessary to provide for the increased load bearing capacity of float modules essentially designed to bear compressive stress and made of concrete for example by means of continuously maintained compressive stress, thus creating a suitably rigid structure that is able to carry superstructures covering more than one float module, and also to provide for fixing said superstructure and the equipment generally needed for navigation in a suitably safe way.

The present invention relies on the recognition that the strength of float modules and the accuracy of connecting them may both be increased, if tension units, serving to connect such modules, are run in such parts of the float modules, namely in the direct vicinity of the edges of said modules, which are supported by side walls against bending outwards; furthermore, the corners of said modules are equipped with corner elements in the line of action of tension units, in which directional recesses with a conical surface are created around said tension units to provide for their proper orientation. The elastomer directional spacer fitting into said recess facilitates the adjusting of resilience and progressive behaviour by means of changing its dimensions. Furthermore, said corner elements provide protection for the most vulnerable points of float modules and also provide for an accuracy approaching that of steel structures to float modules. Finally, float modules may be arranged and connected to each other by means of the tension units that may be installed in all three spatial directions, by turning them around any of their spatial axes.

BRIEF SUMMARY OF THE INVENTION

Accordingly, the present invention relates to a design that facilitates connecting float modules to each other or to the superstructure mounted onto them. The invention may be applied for pontoons constructed of float modules, where prismatic float modules minimally include monolithic side walls and/or frame units arranged along the edges of the float module and float modules are fixed to each other by means of longitudinal tension units led through said float modules. For tension units, boreholes are created in the side walls, upper plate, or the frame units of the float module minimum at the edges of the upper plate of the prism, intersecting the prism and running parallel with the edges. The axes of the boreholes, which meet in the corners of the float module and are oriented in different directions, are skew. A directional recess is created around the exit holes of at least part of these boreholes, into which directional spacers are inserted. Directional spacers have boreholes that contain the relevant tension units. According to the design, at least the surfaces with the boreholes for the tension units are equipped with rigid corner elements at the corners of the float module, which also surround their common edge, where the impact resistance and compressive strength of the material of the corner elements exceed those of the material of the float module; boreholes are created for the exit holes in the corner elements; the directional recesses sunk into corner elements are shaped as truncated cones tapering inwards and the envelope of the directional spacer that fits into the directional recess has the same shape as that of the directional recess.

In a preferred embodiment of the invention, boreholes for tension units running parallel with the edges defined by the side walls of the prism are also created in the side walls, upper plate or frame units of float modules and all the edges of all three surfaces meeting in a corner are covered by the corner element in each corner of the float module.

In a second preferred embodiment of the invention, the cone angle of the directional recess and the directional spacer is at least 90°.

In a third preferred embodiment of the invention, the directional spacer is a body made of resilient material, whose shape takes the form of two truncated cones, with their bases facing each other, and along whose axis the borehole for passing through the tensioning unit is created.

In a fourth preferred embodiment of the invention, the directional spacer to be inserted between two adjacent float modules, in the shape of two truncated cones, with their bases facing each other, is pre-fastened into one of the directional recesses.

In a fifth preferred embodiment of the invention, one part of the corner elements of the float modules is fitted with a concave directional semi-spacer in the position of the sunken directional recess, whose envelope is identical to the shape of the directional recess.

In a sixth preferred embodiment of the invention, the superstructure mounted onto the float module is also fixed by tension elements running parallel with the base and/or the upper plate of the prism and/or by ones running perpendicular to the upper plate of the prism.

Finally, in another preferred embodiment of the invention, the superstructure mounted onto the float module is fixed by expansion fixing units inserted into the borehole created for tension units.

BRIEF DESCRIPTION OF THE SEVERAL VIEWS OF THE DRAWING

The invention is described in detail by means of some examples of embodiment represented in the figures attached, where

in FIG. 1;

in FIG. 1;

in FIG. 1;

in FIG. 13.

DETAILED DESCRIPTION OF THE INVENTION

Figure 1:
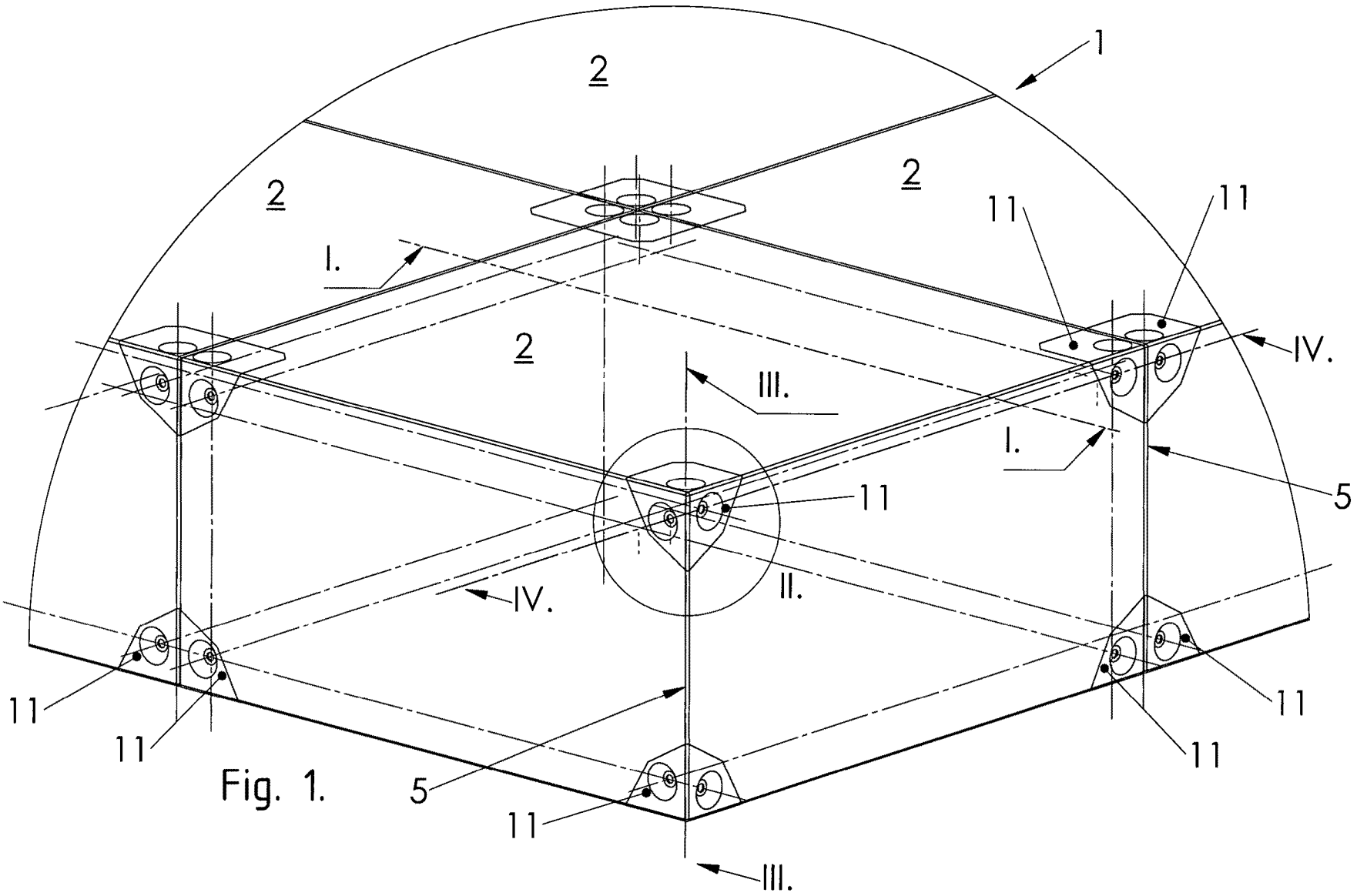
FIG. 1 is the perspective illustration of a section of the pontoon constructed of the invented float modules.

FIG. 1 shows a part of a pontoon that is constructed of the invented float modules 2 where the float modules constituting the pontoon are fully identical.

Figure 2:
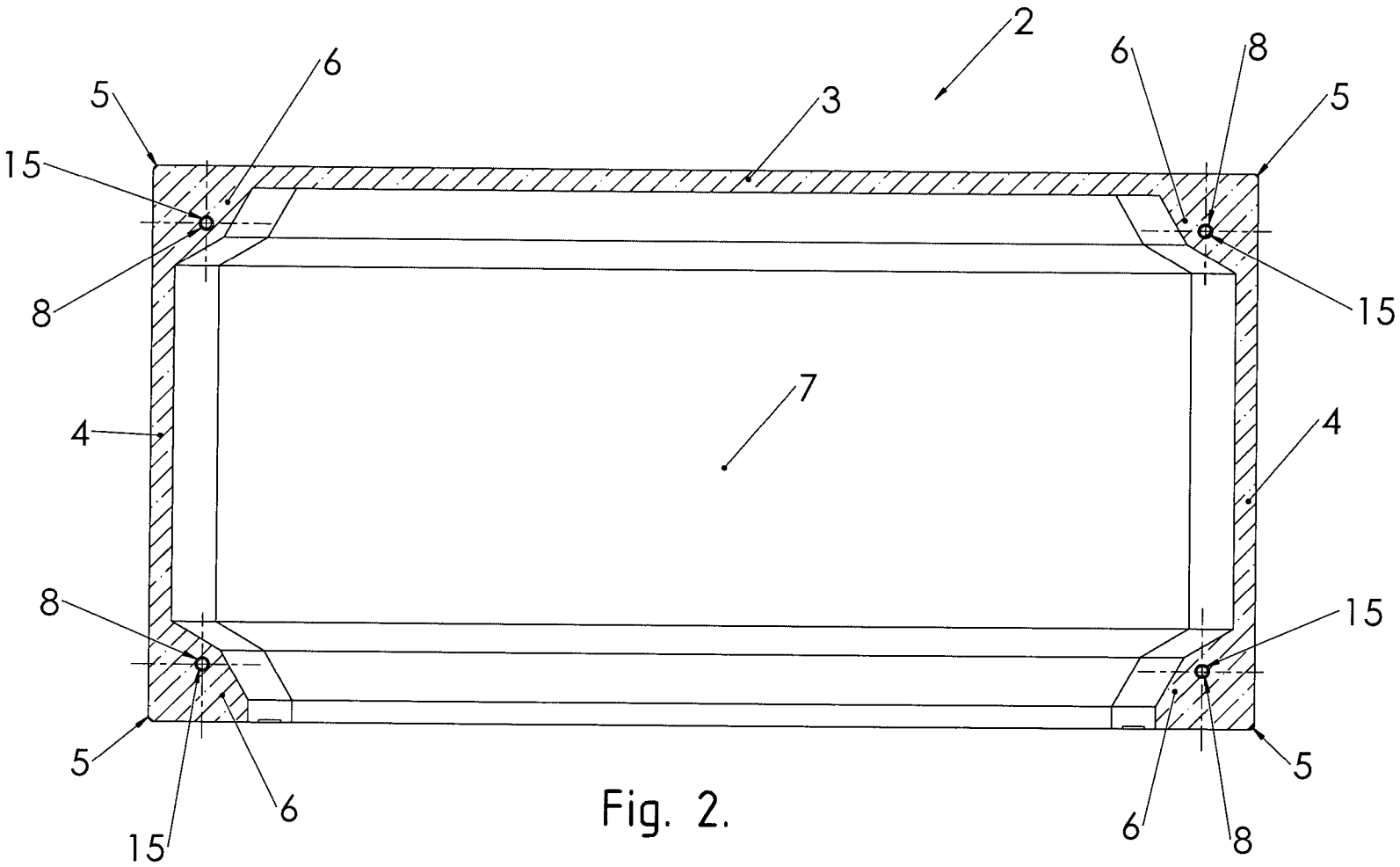
FIG. 2 shows the vertical cross section of a float module marked as I.

Float modules 2 are shaped as square based prisms. Their design is easily understood from FIGS. 1 and 2. Side walls 4 reaching downwards are attached to the edges of their square shaped upper plate 3. As explained later, even though the upper plate is used as a load bearing surface in the case of float modules with similar designs, upper plates or side walls do not have such an exquisite role in the present invention. The bottom of float modules 2 is opened and their interior is filled with plastic foam 7. If the size of float modules 2 is selected properly, they may be used to construct a pontoon 1 which is easily transported by road and cheap to install.

The walls of pontoon units 2 are relatively thin; however, wall thickness is typically increased at all the edges 5 and also at the lower (free) edges 5 of side walls 4. These reinforced parts together form frame units 6 that, together with the side walls 4 as shear elements, create a thorough, reinforced, rigid frame for float modules 2.

Each frame unit 6 is equipped with a longitudinal borehole 8 that runs at the entire length of the unit. The Tx, Ty or Tz axis of such boreholes 8 is parallel with the edge 5 of the given frame unit 6. The exit holes 9 of boreholes 8 open towards the side walls 4 perpendicular to the given edge 5, the upper plate 3 and that surface of the frame units 6 located at the free edges 5 of side walls 4 that runs parallel with the upper plate 3. Each borehole 8 is lined with a protective pipe 10.

Figure 3:
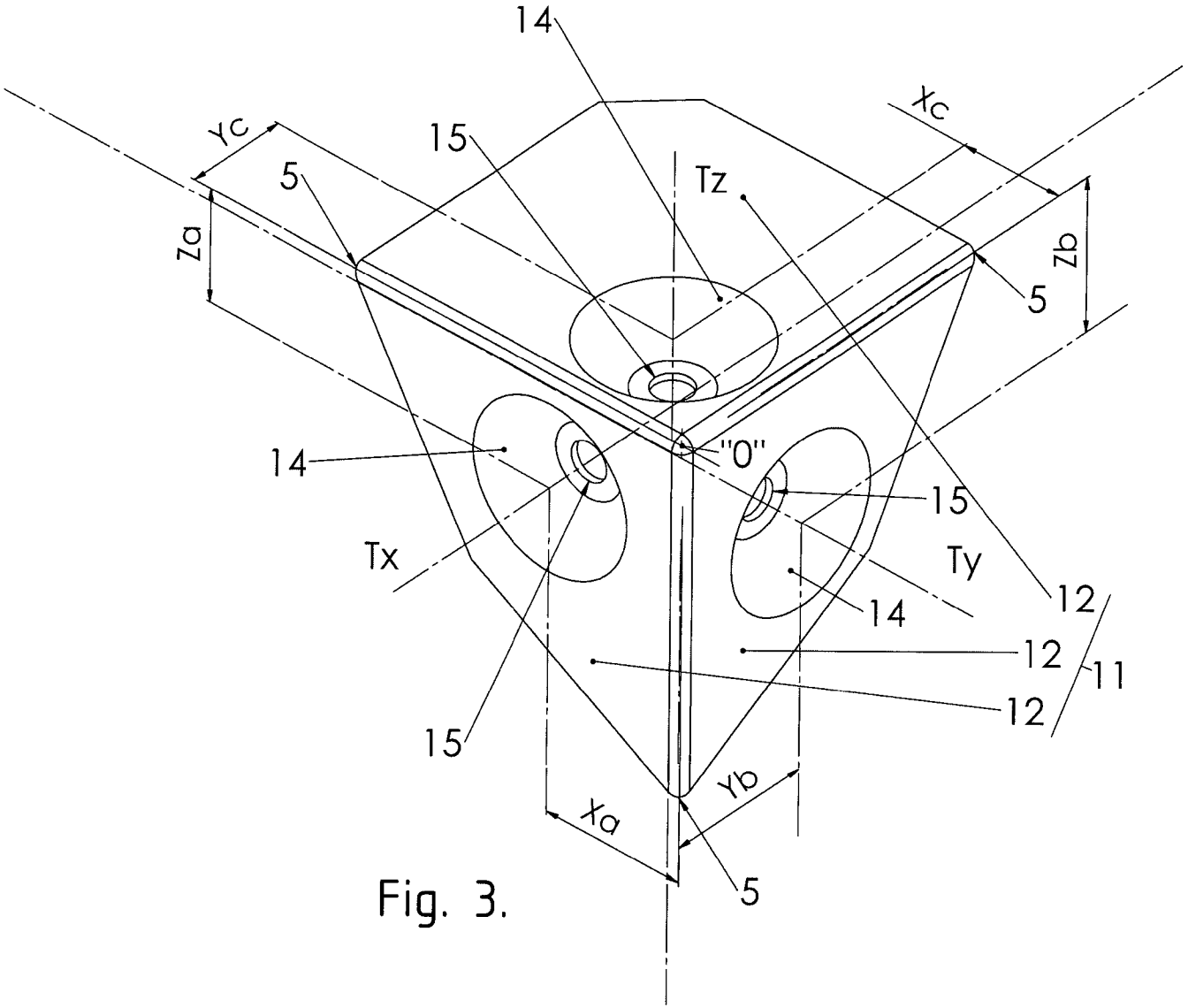
FIG. 3 shows a magnification of Part II of the float module as illustrated in FIG. 1.
Figure 4:
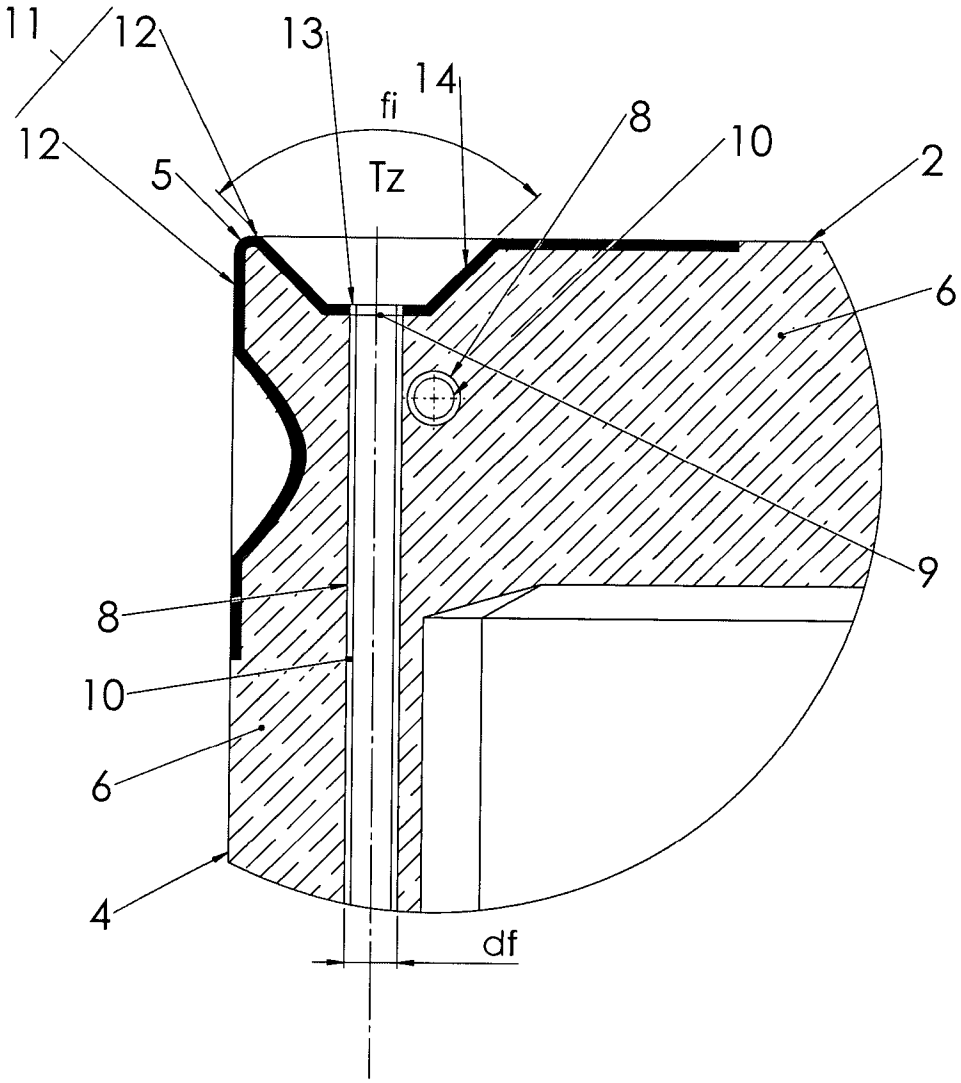
FIG. 4 shows the partial vertical cross section of a float module marked as III.

Each corner of the float modules 2 is equipped with a corner element 11 as illustrated in detail by FIGS. 3 and 4. In this embodiment, corner elements 11 are made of stamped steel sheets with three plates 12 which are perpendicular to each other and together form a pyramid-like peak. The external surface of plates 12 fits into the relevant surface of the float modules 2.

Each plate 12 is equipped with a borehole 13 which overlaps with the exit holes 9 of the boreholes opening in the given corner and around which a directional recess 14 is created. The directional recess 14 is essentially shaped as a truncated cone with its base extending towards the external surface of the plate 12 and its axis corresponding to that of the borehole 13. The smaller diameter of said truncated cone is larger than that of the borehole 13, hence the surface of the directional recess 14 is even around borehole 13. In this embodiment, the cone angle $\phi$ of the truncated cone is 90°, but it can also be larger. As explained later, a lower value is not recommended as it would eliminate a technological advantage of the invention. Under the directional recesses 14, the float module 2 also has suitable spaces.

Corner elements 11 may be manufactured by technologies other than stamping, for example by various moulding or other forming processes. In such cases, corner elements 11 may have a design other than the sheet shape, for example they may be shaped as slabs.

Figure 5:
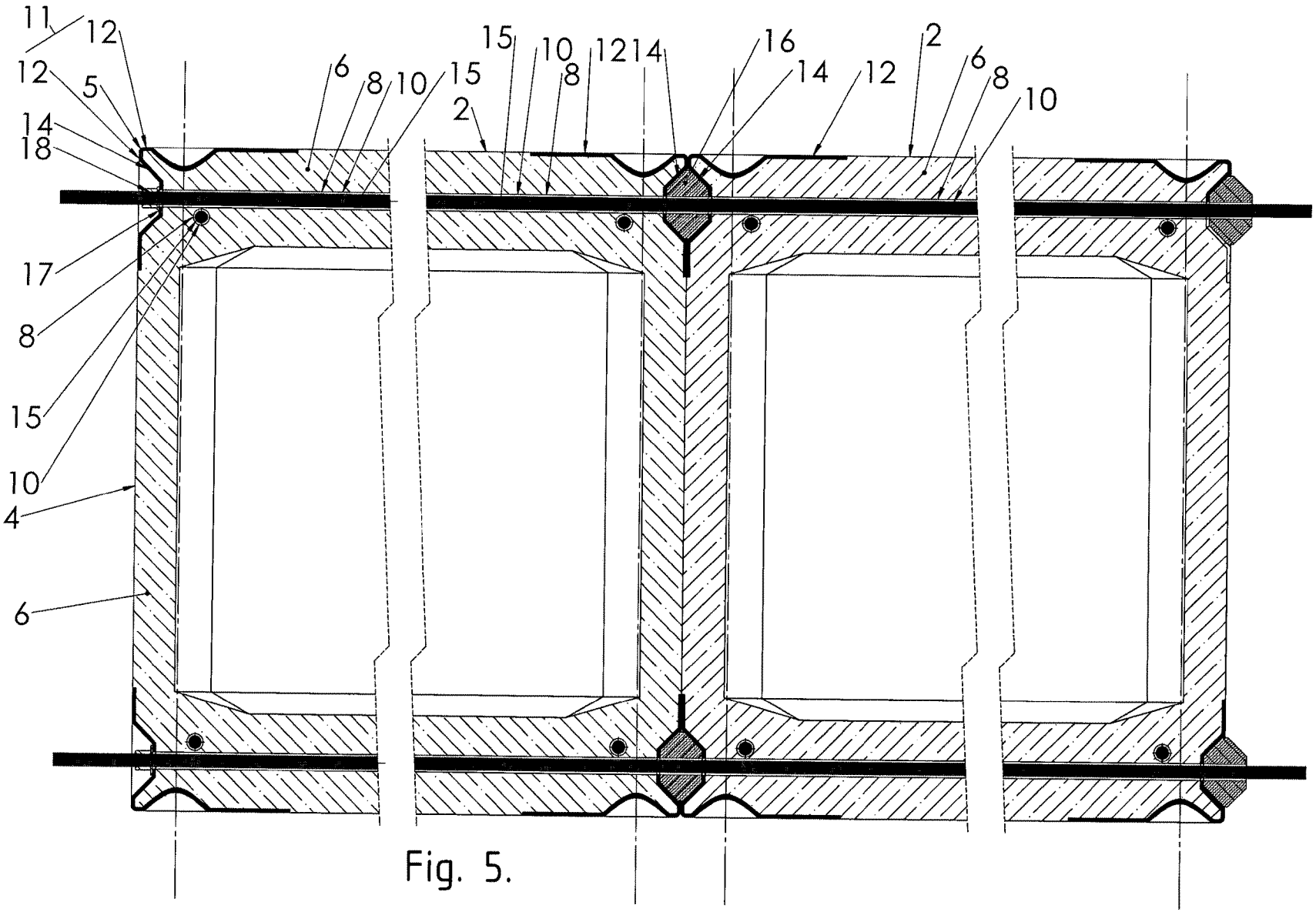
FIG. 5 shows the partial vertical cross section of a float module marked as IV.

FIG. 3 illustrates the position of directional recesses 14 in corner elements 11. As illustrated by the figure, if the peak of the corner element 11 is considered as an origin of coordinates "0", then a distance Xa belonging to the directional recess 14 with an axis Tx and a distance Yb belonging to the directional recess 14 with an axis Ty are identical; however, the difference between the distances Za and Zb exceeds the diameter df (shown in FIG. 4) of the borehole 8. Distances XC and Yc belonging to the directional recess 14 with an axis Tz are identical and smaller than the distances Xa and Yb, while the difference here again exceeds the diameter df. Obviously, the axes Tx, Ty and Tz of the boreholes 8 running into the same corner of the float module 2 form three skew lines. As given by the position of the boreholes 8, the area of plates 12 is more or less the same as the diameter of frame units 6.—The construction design of the pontoon 1 is described by FIG. 5.

Float modules 2 in the number needed to construct the pontoon 1 of the desired size are floated near each other and then the tension units 15 are led through boreholes 8 that are along the same line. Tension units 15 are corrosion protected bars threaded at both ends.

Each tension unit 15 is equipped with a directional spacer 16 positioned between neighbouring float modules 2. Directional spacers 16 are made of a solid, resilient material and their surface forms two truncated cones joined at their bases and having a shape identical to that of directional recesses 14. Accordingly, any given directional spacer 16 will centrally fit into the adjacent directional recesses 14 of neighbouring float modules 2, thus defining the position of said neighbouring float modules 2 and transferring the force generated by the tension unit 15. Also, it transfers shearing forces generated between the float modules 2 and helps in compensating for unequal load distribution and inaccurate fits resulting from size variation, hence improving the size accuracy of the constructed pontoon 1.

The dimensions of directional spacers 16 are defined in a way that the two directional recesses 14 facing each other are completely filled while providing for the desired distance of float modules 2. Due to the principle of constant volume, directional spacers 16 will only allow the further proceeding of float modules 2 to each other by spacers 16 extending into the recesses. Accordingly, the resistance of the system along the axis increases drastically, facilitating the rigid fixing of float modules 2. Resilient directional spacers 16 have a further role in distributing loads between float modules 2.

Once the tension unit 15 has been led through each adjacent float module 2, it is tensed by means of nuts 18 and washers 17 placed into the directional recesses 14 of the external corner units 11 of the two float modules 2 at each end of the structure. This way, the tension unit 15 and the resilience of the directional spacers 16 provide the force necessary to fix float modules 2 to each other.

Steel cables may also be used as tension units 15 instead of the bars described above. They may be tightened by turnbuckles or form-closed joints on one end and on the other end a resilient closing element with lentil shaped spring and valve nut fixing or a hydraulic power cylinder with the tension unit led through it.

As obvious from the description of operation, directional spacers 16 have a double role: they facilitate the solid connection of float modules 2 and they protect the most vulnerable part of float elements 2 from potential damage.

The cone shaped design of directional recesses 14 and directional spacers 16 does not only facilitate the accurate connection of float modules 2. A cone angle $\phi$ of 90° also facilitates the replacement of a damaged float module 2 located at one of the most vulnerable corners without the need for floating the entire pontoon 1 apart, as once the tension units 15 are pulled out, said damaged unit 2 may be removed diagonally, in parallel with those extreme walls of the 90° $\phi$ cone angle directional recesses 14 which are more distant from the direction of extraction and lie in the currently horizontal plane, and the new unit 2 may be inserted without moving the other float modules 2. If directional recesses with a smaller cone angle $\phi$ were used, these walls would lean toward each other, thus preventing the diagonal removal and re-insertion of float module 2.

The new design of float modules 2 significantly increases the number of potential pontoon 1 designs constructed from the float modules. This is due to the previously mentioned fact that the upper plate 3 and the side walls 4 have no specific default position.

Figure 6:
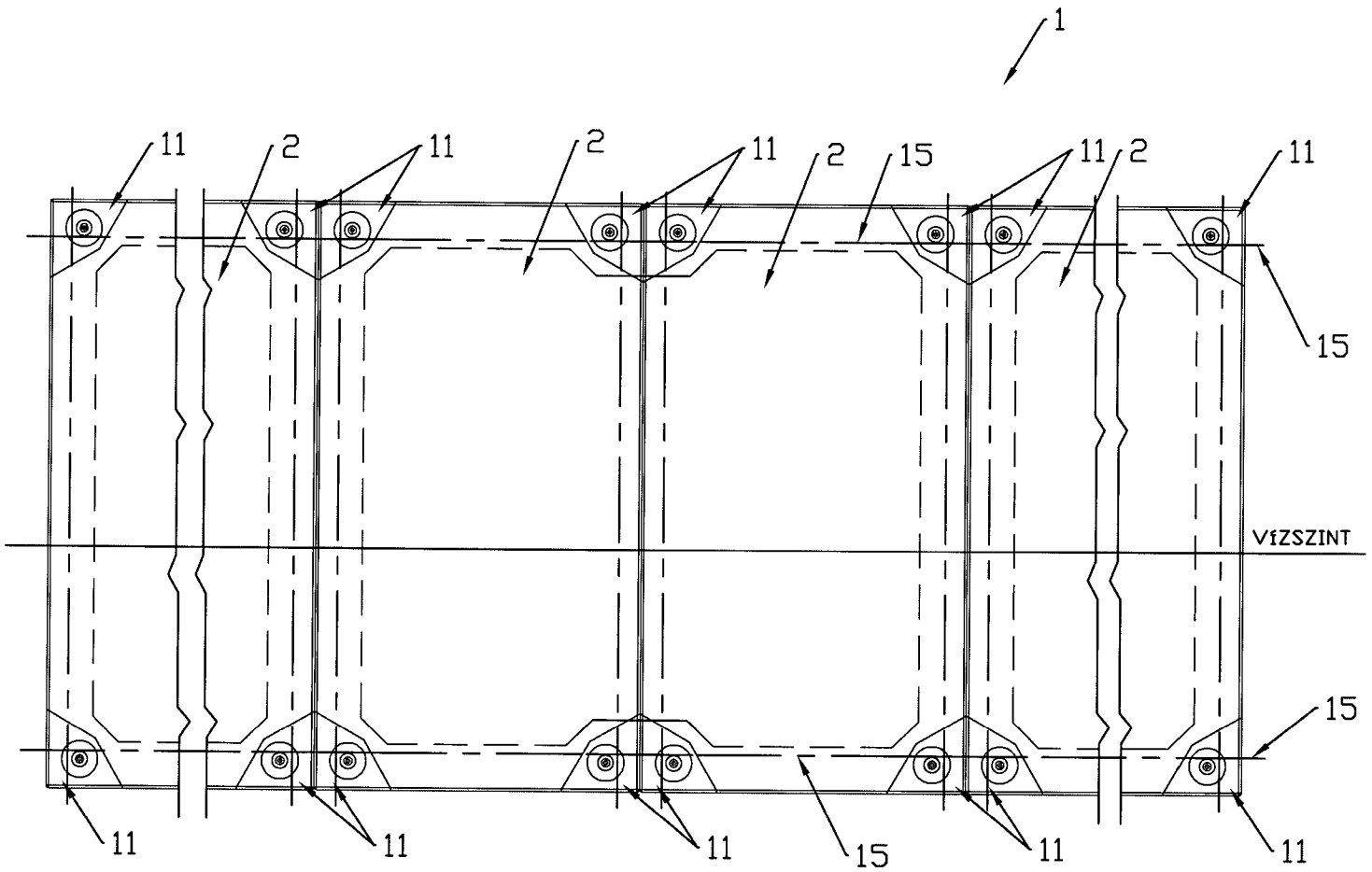
FIG. 6 illustrates an alternative to 10 illustrate alternatives to connecting float modules.

In the arrangement shown in FIG. 6, float modules 2 are connected via their vertically positioned upper plates 3. As boreholes 8 are also created parallel with the common edges 5 of side walls 3, float modules 2 may also be accurately connected in this arrangement and fixed by the tension units 15 led through said boreholes 8. This specific design facilitates the construction of pontoons 1 of increased height with an increased load bearing capacity.

Figure 7:
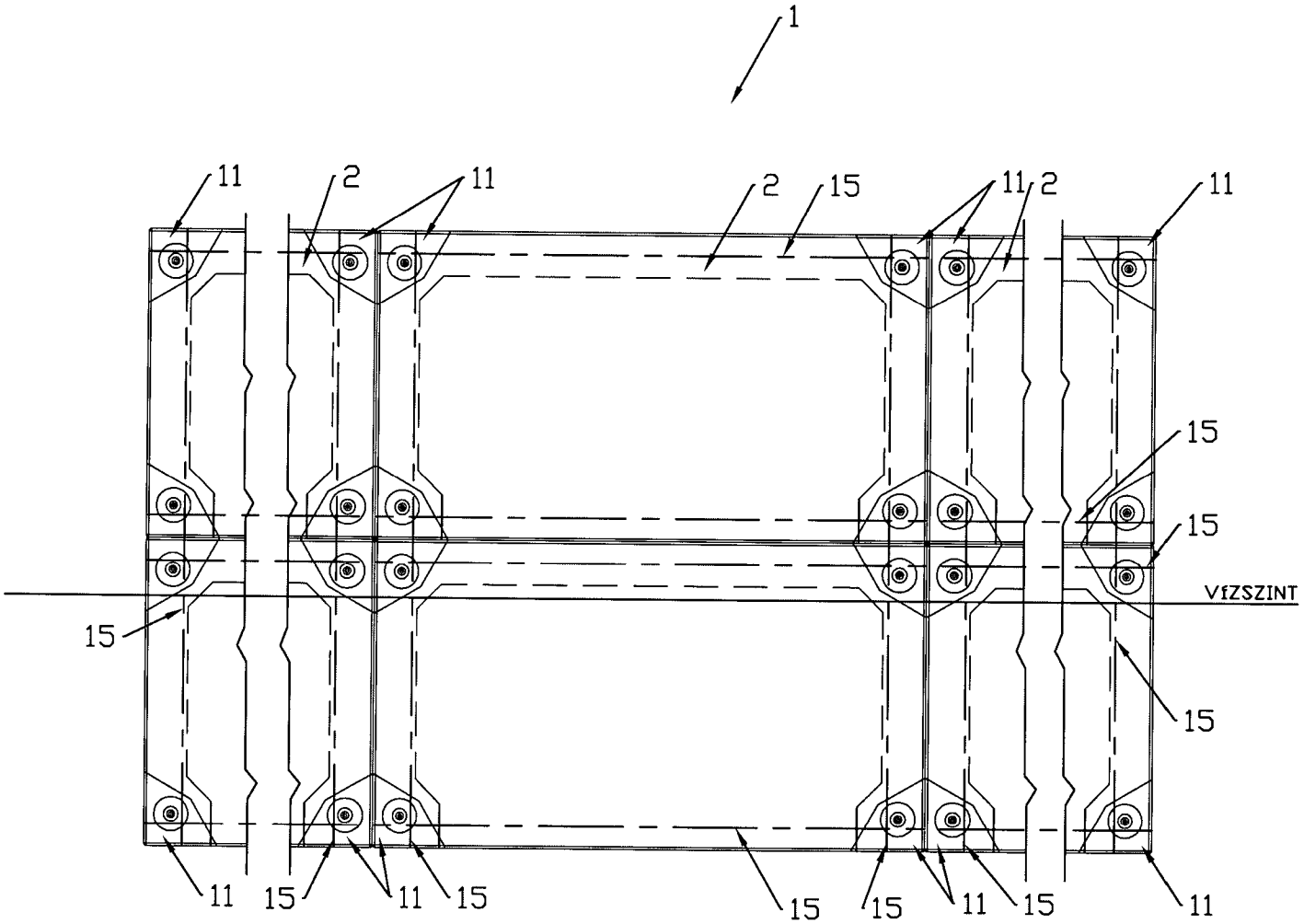
FIG. 7 illustrates an alternative to connecting float modules.

Boreholes 8 running parallel with the common edges 5 of side walls 3 also facilitate the connection of float modules 2 as illustrated by FIG. 7. In this case, float modules 2 are placed on each other in two rows and overlapping rows are fixed to each other by the tension units 15 led through said boreholes 8. This also facilitates the construction of pontoons 1 of increased height with an increased load bearing capacity.

Figure 8:
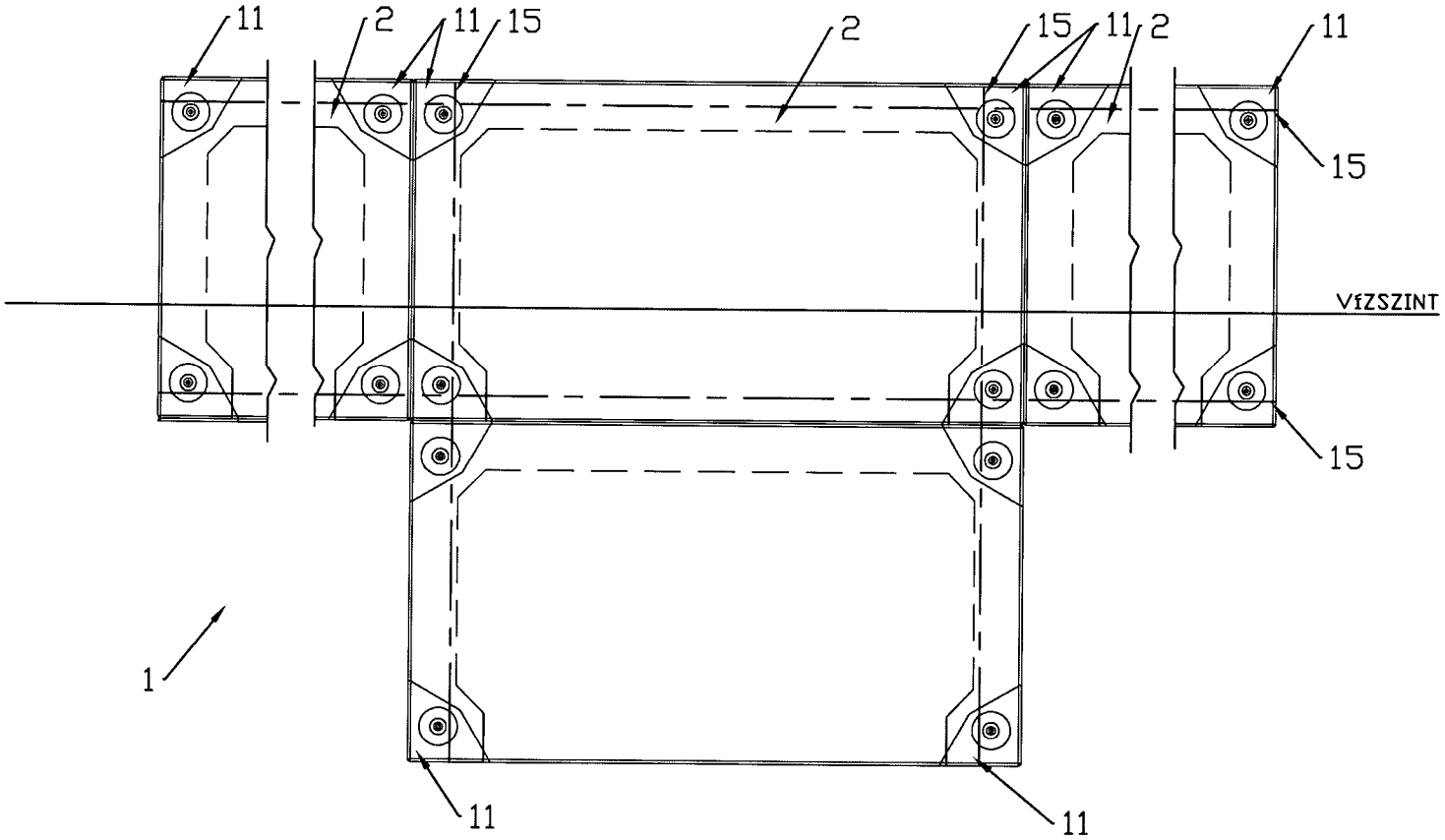
FIG. 8 illustrates an alternative to connecting float modules.

By uneven loading, the design shown by FIG. 8 is recommended. This design is essentially identical to the one described above, the only difference being that the height of the pontoon 1 is increased by a second row only where it is justified by increased loads. Obviously, in this case float modules 2 added later are positioned below the coherent field of previously installed float modules.

Figure 9:
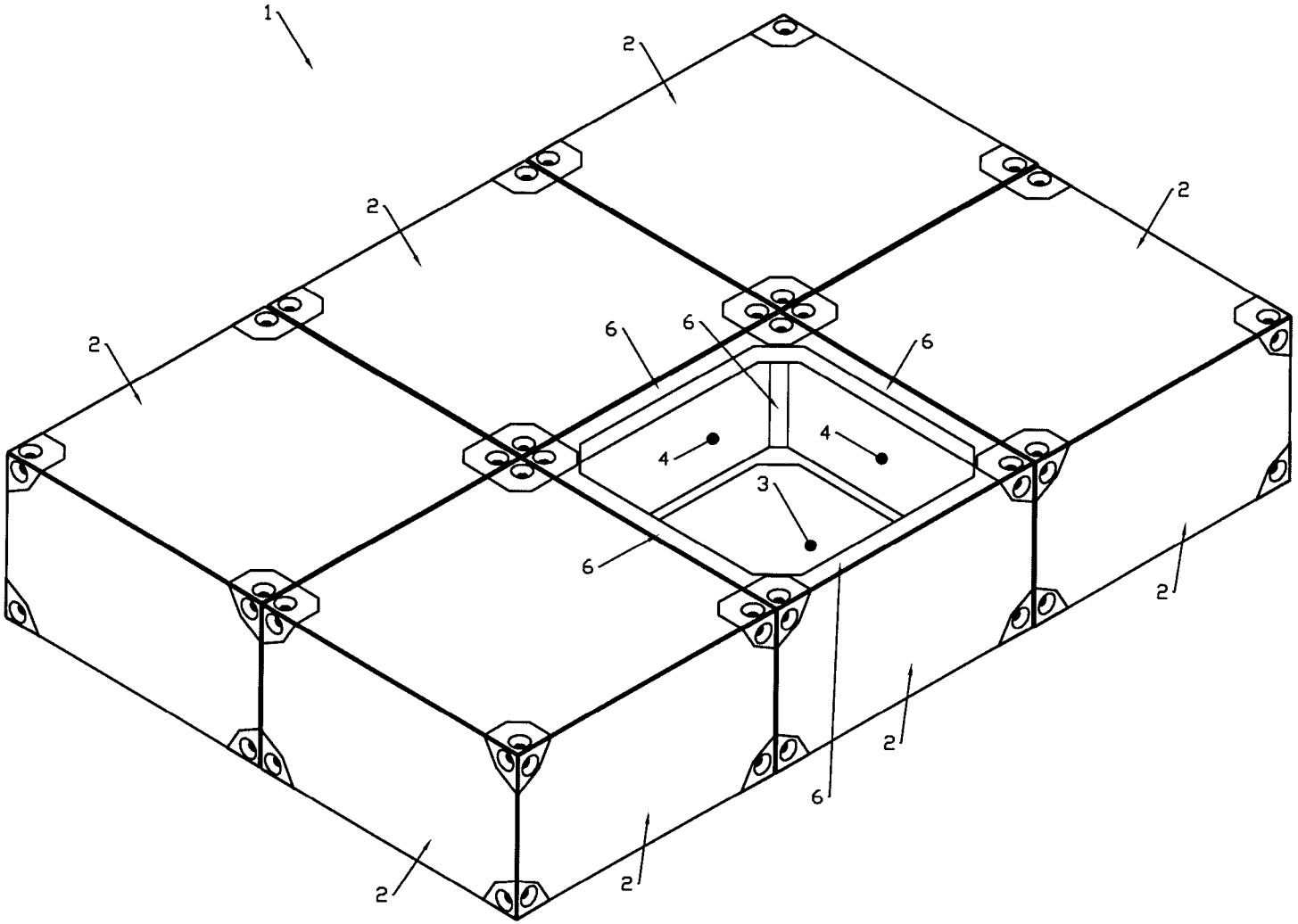
FIG. 9 illustrates an alternative to connecting float modules.

Another preferred embodiment is the design shown by FIG. 9. A float module 2 is turned with its opened bottom up, the foam filling 7 is removed and the empty float module 2 is fitted into the pontoon 1. This way, a storing unit is inserted into the uniform surface, where the mechanical equipment of the superstructure may be installed for example.

Figure 10:
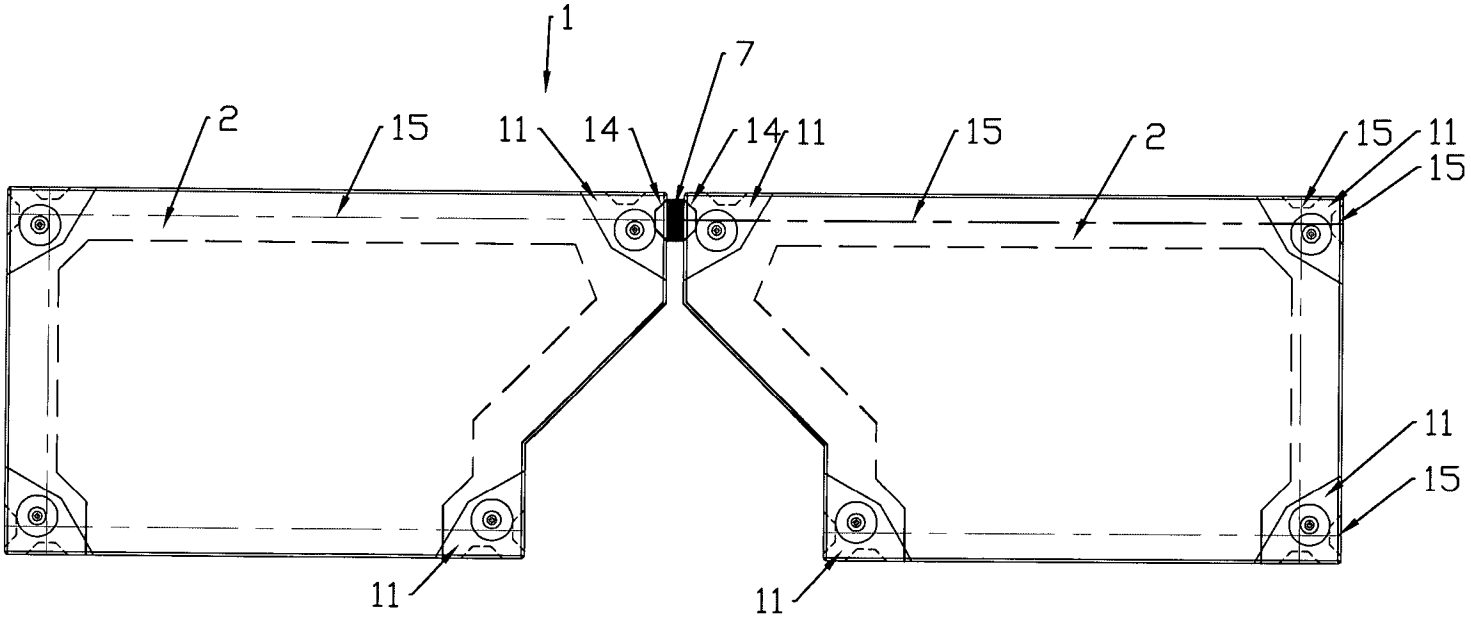
FIG. 10 illustrates an alternative to connecting float modules.

By increasing the dimension of the directional spacer 16 along its axis, the distance between neighbouring float modules 2 may be increased, facilitating the construction of the connection illustrated by FIG. 10, where float modules 2 are accurately positioned at a preset distance from other, forming a flexible structure. This design is recommended for alternatives where units are allowed to turn around an edge at a wide angle.

Figure 11:
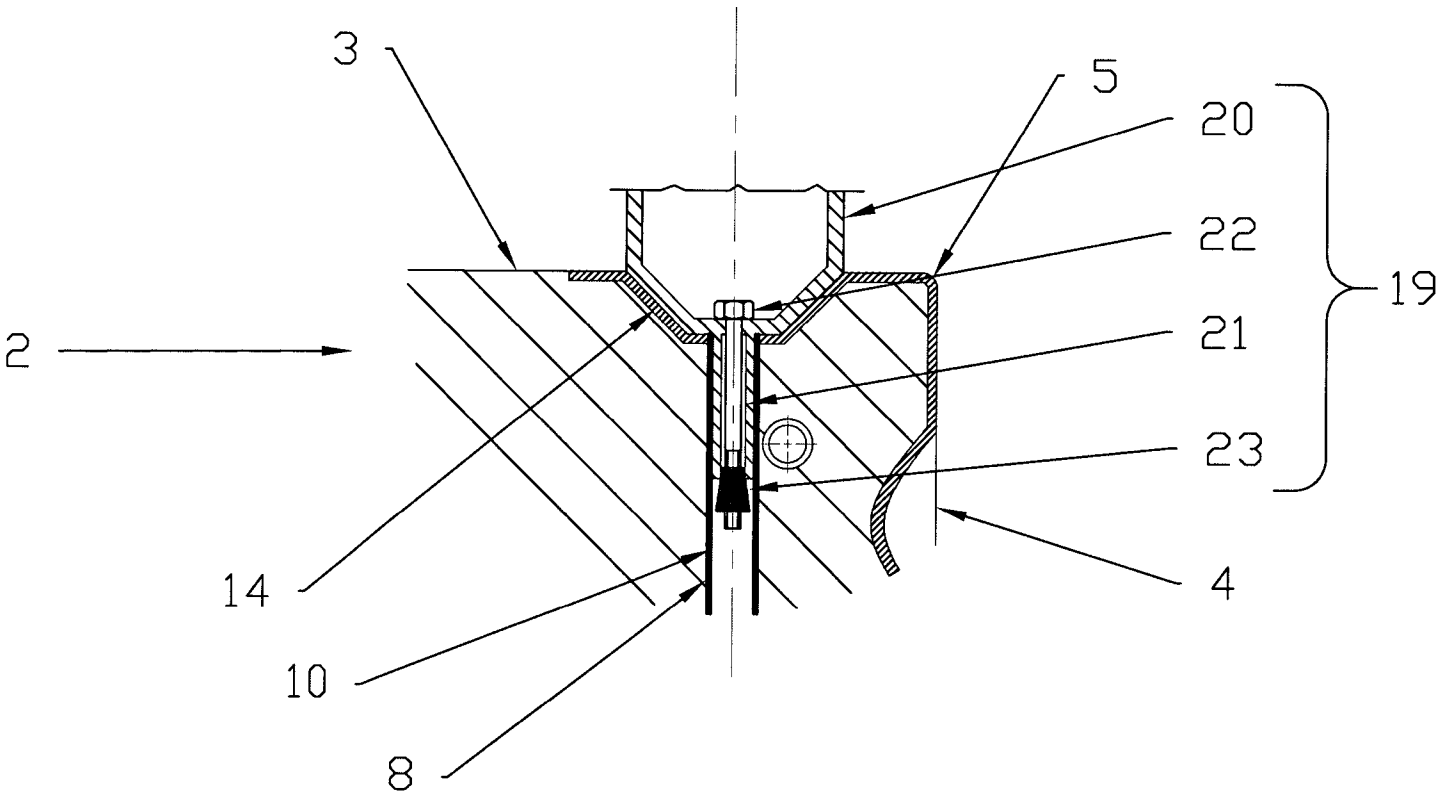
FIG. 11 shows the longitudinal cross section of a tool developed to fix superstructures.

Boreholes 8 running parallel with the common edges 5 of side walls 3 do not only facilitate the fixing of float modules 2 in a way that diverges from the ordinary, but are also suitable to fix the superstructure. One way of this is to fix the superstructure by means of the tension units 15 led through the aforementioned vertical boreholes 8. Another method is illustrated by FIG. 11. In this alternative, the aforementioned vertical boreholes 8 and the directional recesses 14 surrounding them are used, combined with an expansion fixing unit 19. The expansion fixing unit 19 is constructed of a goblet shaped seat 20—the figure only shows its bottom part as the upper part may have various designs depending on the object fixed and the reason for fixing it—and the split projection 21 connected to it from below. The split projection 21 inserted into the borehole 8 is fixed by the fixing screw 22 and the tension wedge 23 at its end. By these methods, equipment generally needed for navigation may be fixed on float modules 2 such as cleats, skid holders or anchors.

Two corner elements 11 located above each other vertically may be used to fix pool ladders or boat cranes to the pontoon. The upper recesses of two neighbouring corner elements 11 may be used to fix rails for bitts or double cleats. By means of spreaders, a catamaran design may also be developed. If necessary, the pontoon 1 may be equipped with an outboard motor, by means of fixing an outboard motor base on it using neighbouring corner elements 11 and expansion fixing units 19.

Figure 12:
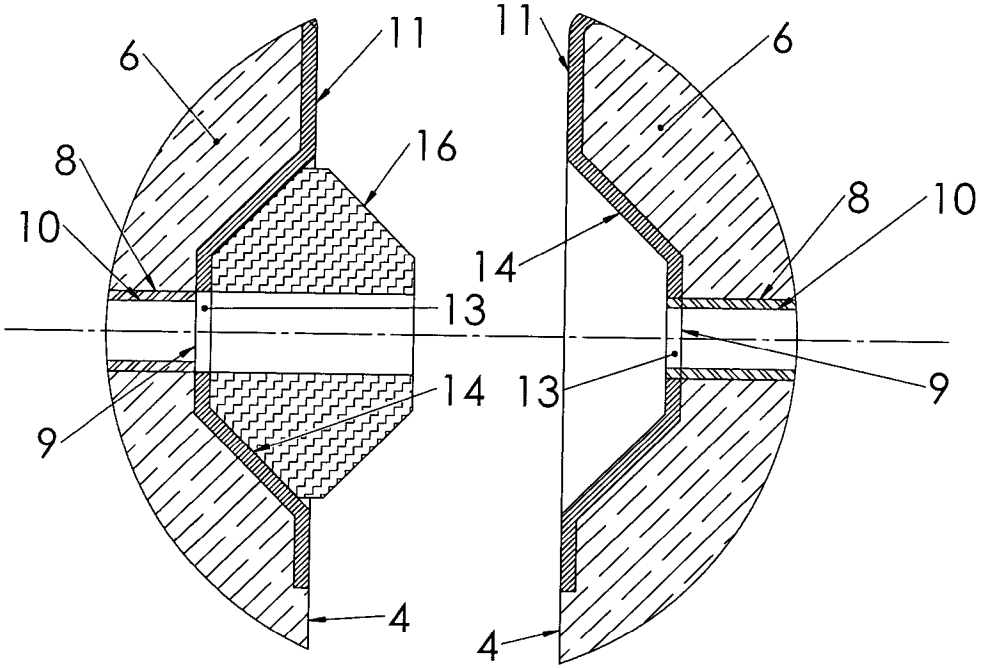
FIG. 12 shows an axial cross section of the directional spacer fitted into the invented corner element.

The assembly unit and especially the eventual replacement of float modules 2 can be facilitated in the manner shown in FIG. 12. A part of the directional spacer 16 is fastened by gluing on a surface into directional recess 14 of the corner element 11 which houses this part. The permanent fastening of the directional spacer 16 effectively creates male-female sides. This makes it significantly easier to pass through tensioning unit 15 at the junction of float modules 2, which represents a major advantage for connections beneath the water surface. Naturally, since the corresponding corner element 11 of float module 2 must contain an "empty" directional recess 14, a regular system must be designed and followed for gluing.

Figure 13:
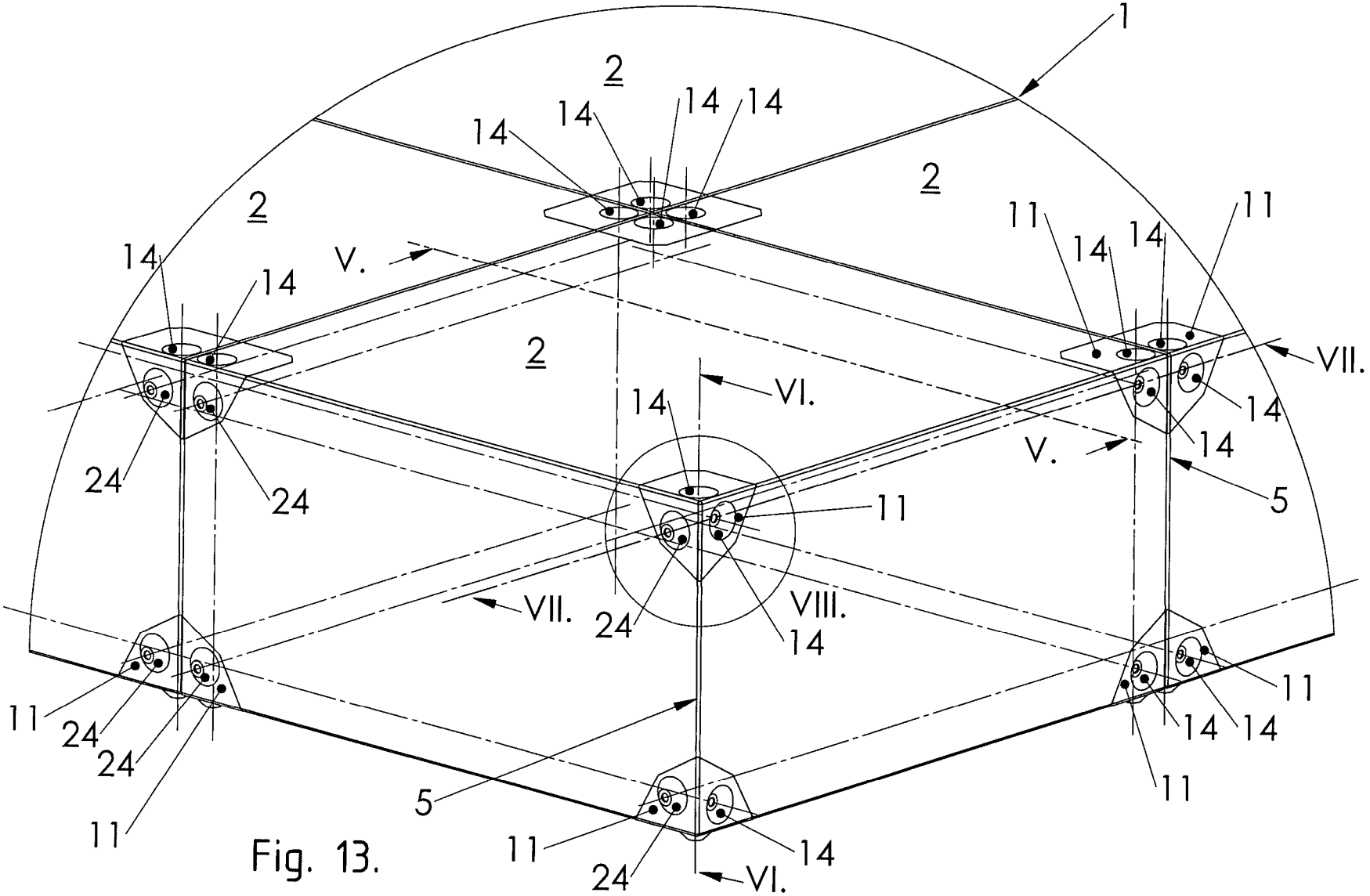
FIG. 13 is the perspective illustration of a part of another embodiment of the invented corner element.
Figure 14:
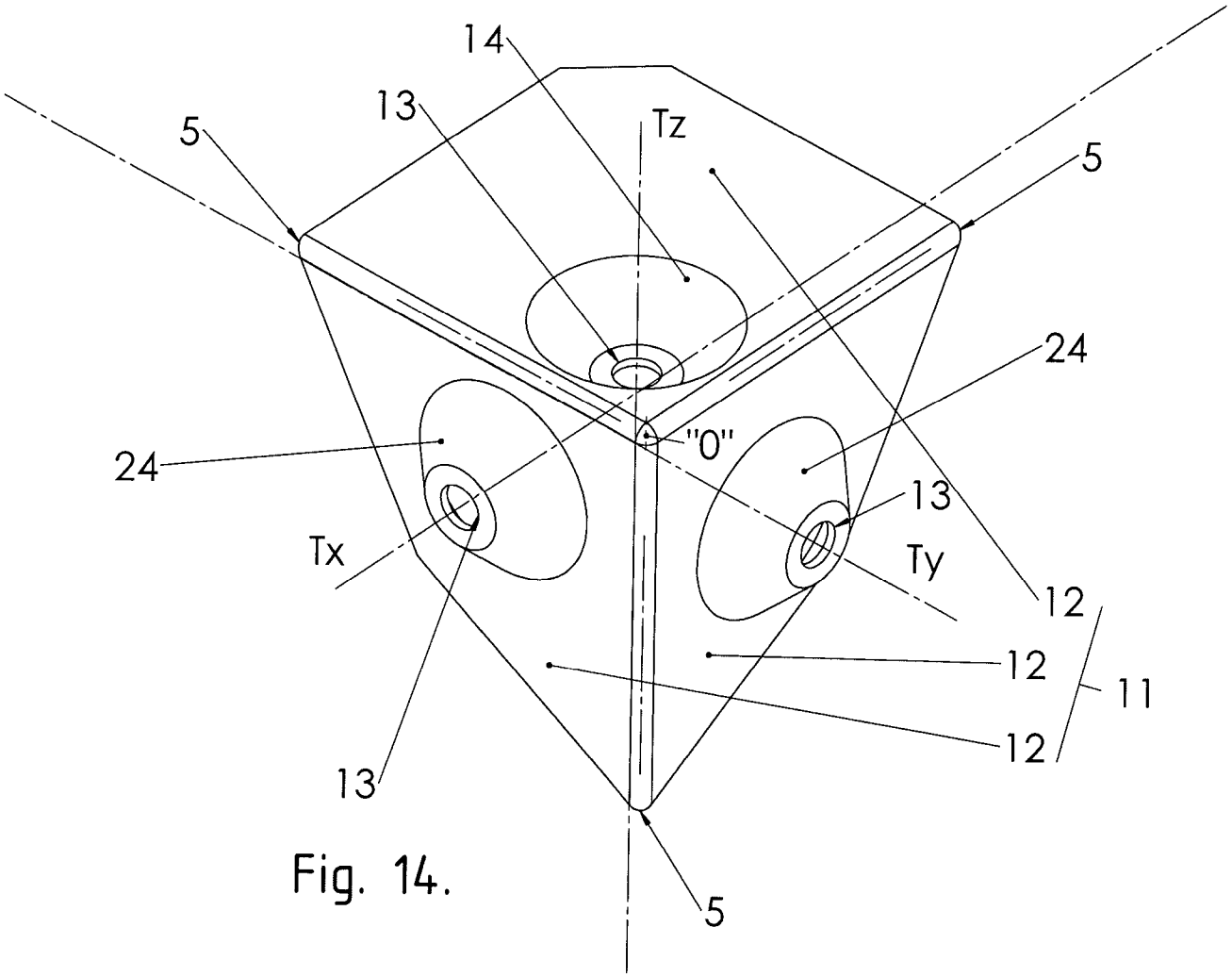
FIG. 14 shows a magnification of Part V of the float module as illustrated in FIG. 13.
Figure 15:
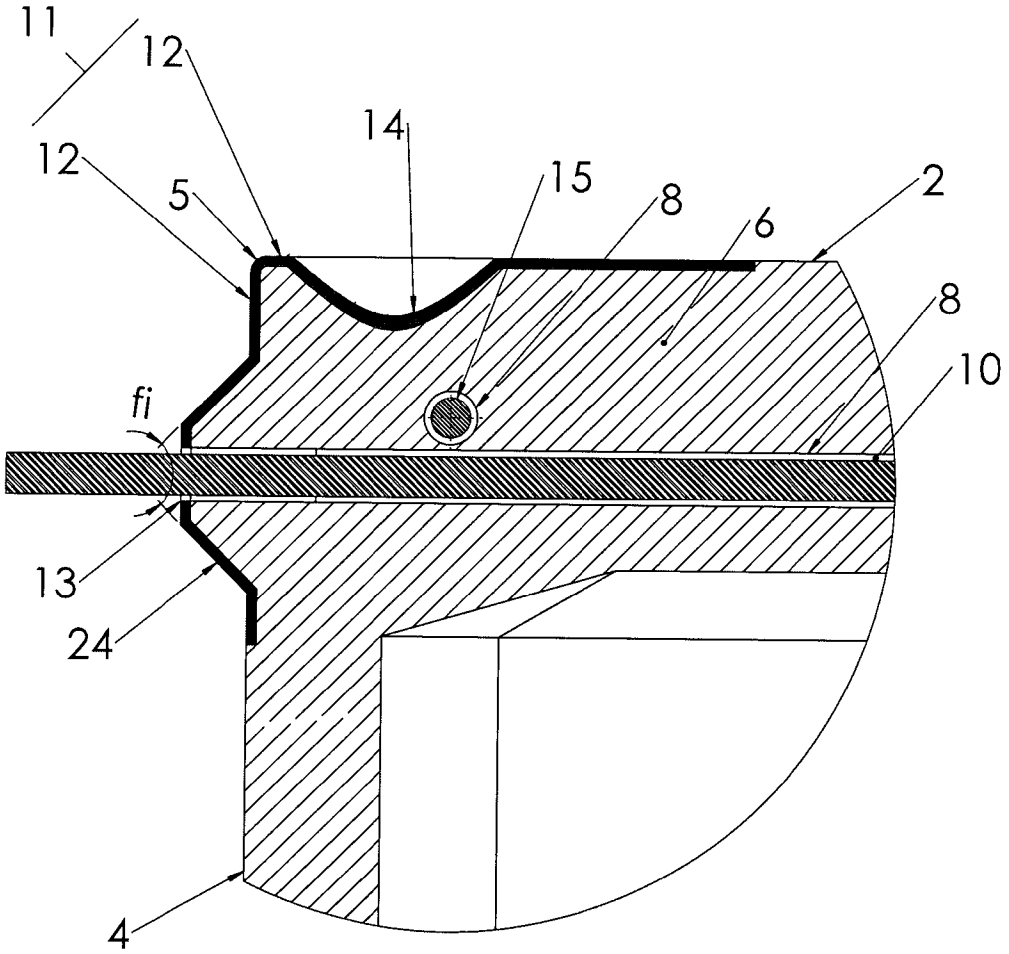
FIG. 15 shows the partial vertical cross section of a float module marked as VII. in FIG. 13.
Figure 16:
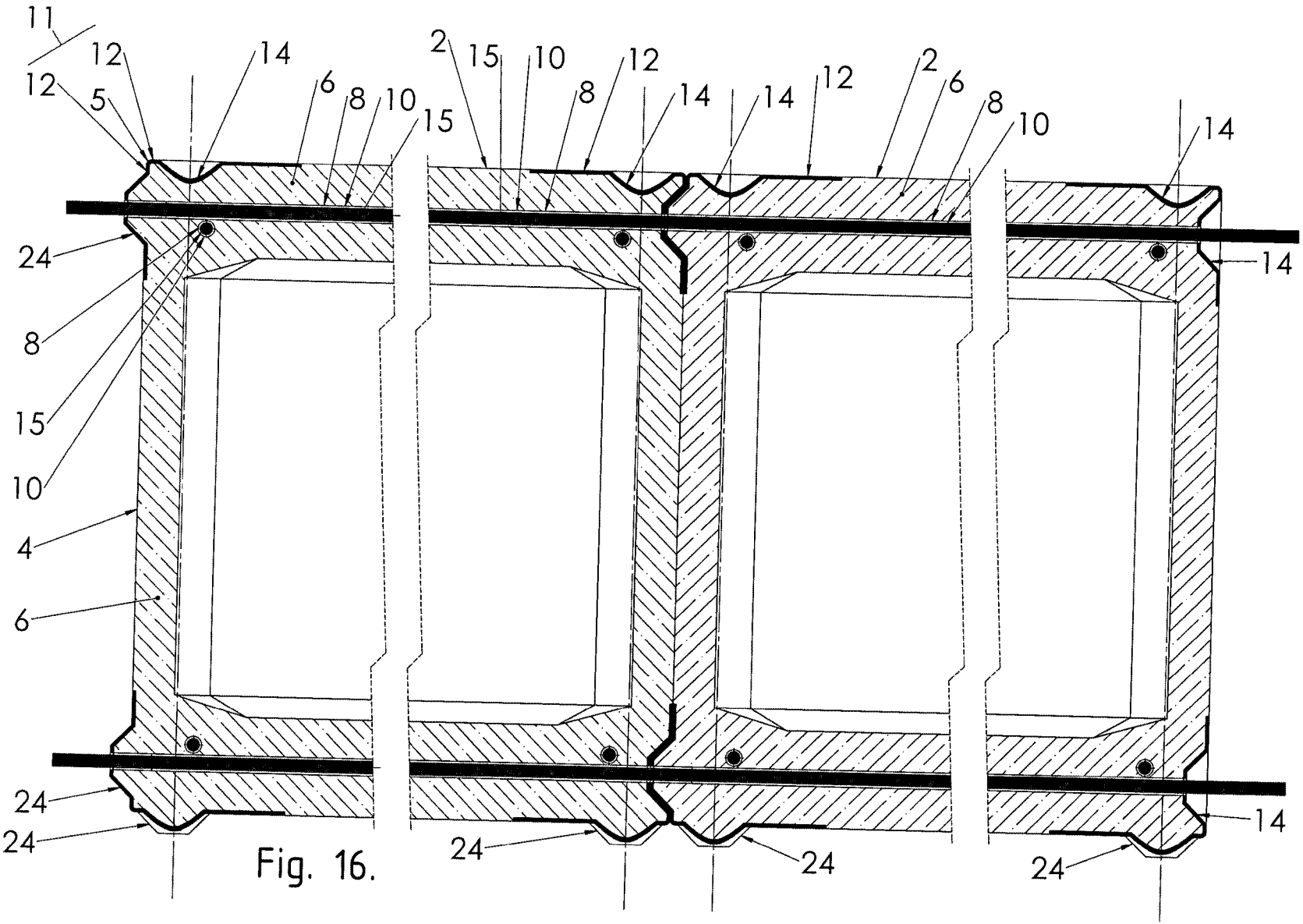
FIG. 16 shows the partial vertical cross section of a float module marked as VII.

The alternative presented in FIG. 13-14, which is analogous to the case of directional spacers 16 permanently fastened into corner elements 11, requires more precise manufacturing, but also enables more accurate assembling. As can be seen in FIG. 13 from one, two, or all three plates 12 of corner element 11—depending on the application—a conical form protrudes instead of directional recess 14, whose shape is identical to one half of directional spacer 16, which has the shape of a truncated cone. During the manufacturing of float module 2 the conical form is filled with concrete, thus producing a rigid directional semi-spacer 24. This allows the adjacent float modules 2 to be connected without using the resilient directional spacer 16, completely rigidly and immobilised with respect to each other, which has significance for structures and superstructures mounted onto several float modules 2. The aforementioned favourable properties for disassembly and assembly also apply to this alternative. Naturally, the directional semi-spacers 24 must be arranged with the same regularity for individual float modules 2.

The advantages of the present invention are manifested at several levels.

A favourable basic characteristic of the invention is that corner elements located at the corners of float modules—prisms—, extending into all three directions and comprising cone shaped directional recesses at all three adjacent sides, are able to form connections in all three spatial directions by means of their cone shaped directional spacers and the tension units led through said corner elements.

In a preferred embodiment of the corner element proposed in the present invention, it is suitable to connect modules made of concrete or other materials that are essentially characterised by a high compressive strength and to protect their corners when said corner element is fixed by steel reinforcement and tensioning units are led along edges in protective pipes of high compressive strength that connect/support cone shaped directional recesses. This way, the corner element may be used to connect any types of bodies with a braced shell structure in the case of metal and plastic structures (steel-aluminum, etc., float modules and fibre reinforced etc. float modules, respectively), where said corner elements are made of the own material of float modules by means of reinforcing the corners and connecting is facilitated by tension units led in load carrying pipes in the internal space of units.

Further favourable characteristics of the invention are manifested at installation.

Tension units together with the protective pipes of high compressive strength running in float modules form a Bowden cable-like system, i.e. the tension unit prevents the supporting protective pipe from bending outwards. When float modules are fixed to each other forming a pontoon field, tightened tension units and frame unit-like structures located on the edges and forming a prismatic frame running along the edges of the prism act together as a Bowden cable structure i.e. the tightened tension unit runs very near along the central line (core) of the borehole with a protective pipe that form a frame unit. Similarly to a Bowden cable system, the force system thus created does not allow the bending out of the frame unit, hence increasing the load bearing capacity of the float module.

The tension unit led through the elementary frame units of the chain-like system thus created operates in a similar way, i.e. it provides for the compressive load on elementary frame units even when the relative position of such units shifts like that of the beads in a necklace and the connection facilitated by the cone shaped elements of the connecting system prevent the overlapping of edges and the generation of extra bending moment where the units meet.

Favourable characteristics are also manifested when float modules are assembled to form a pontoon field.

One such further favourable basic characteristic is that thanks to the cone-shaped design of directional recesses and corner elements, corner elements can be connected and detached from the direction of the axis of the cone-shaped directional recess all the way to the direction of the wall of the cone. As a result, following the removal of the inserted tensioning units the float modules previously connected on their two perpendicular sides can be pulled or floated out from the internal corners lying in their plane along the angle bisector (diagonally), and replacement units may be floated to their place in the same way and assembled by re-tightening the tensioning units.

Accordingly, when a float module needs to be replaced or extra float modules installed in an internal corner, it is not needed to disassemble the pontoon field and the favourable characteristics of the tension units described previously may be preserved. It means that a float module located at a given corner of the pontoon field and connected to it via its two adjacent perpendicular sides may be floated out of the field diagonally by disconnecting and partially pulling out the tension units led through it. This is facilitated by the cone shape design of corner elements.

The three favourable characteristics described in the previous sections are also present along the spatial diagonal of the pontoon; that is a float module may be lifted out and removed along its spatial diagonal from its connected position in the inner corner by means of partially pulling out the tension units led through it. This is also facilitated by the cone shaped design of corner elements.

From the above characteristic it follows that the disassembly and assembly of float modules is also possible along the diagonal of the modules. As a result, the float modules of a pontoon field can be floated alongside each other along a greater distance in both directions with respect to each other, all tensioning units and directional spacers can be inserted into the float modules in a single step, and by tightening the tensioning units nearly simultaneously the pontoon field can be stretched to the necessary extent in a single phase. The operation described above can also be carried out in the direction of disassembly, without the complete disassembly of float modules.

Finally, the favourable characteristics described in the previous sections are also present when the pontoon field is constructed by connecting the bottom and upper plates of float modules i.e. when the pontoon constructed includes float modules arranged in one row and the pontoon has increased height.

LEGEND

"O"—origin of coordinates
Tx—axis
Ty—axis
Tz—axis
df—diameter
xa—distance
xb—distance
xc—distance
ya—distance
yb—distance
yc—distance
za—distance
zb—distance
zc—distance
ϕ—cone angle
1—pontoon
2—float unit
3—upper plate
4—side wall
5—edge
6—frame unit
7—foam filling
8—borehole
9—exit hole
10—protective pipe
11—corner element
12—plate
13—borehole
14—directional recess
15—tension unit
16—directional spacer
17—washer
18—nut
19—expansive fixing element
20—seat
21—split projection
22—fixing screw
23—wedge
24—directional semi-spacer

The invention claimed is:

1. A structure to connect float modules to each other for creating pontoons constructed of concrete float modules, comprising a plurality of prismatic float modules, each prismatic float module of the plurality of prismatic float modules including at least a monolithic upper plate, side walls and a frame unit arranged to form a plurality of edges of said each of said plurality of prismatic float modules, each of said prismatic float modules of the plurality of prismatic float modules [ [ are]] fixed to at least one other prismatic float module of the plurality of prismatic float modules by means of a longitudinal tension unit led through said plurality of prismatic float modules in one of the boreholes created for said longitudinal tension unit in said monolithic upper plate of each of said prismatic float modules at least at one of the plurality of said edges of said monolithic upper plate of each of said prismatic float modules, intersecting each of said prismatic float modules and running parallel with one of the plurality of said edges, an axis of at least one of said boreholes oriented in different directions meet in one of corners of each of said prismatic float modules, and directional recesses are created around exit holes of at least one of said boreholes, into which a directional spacer is inserted between each of said prismatic float modules, each said directional spacer comprising at least one of said boreholes for letting through said longitudinal tension unit wherein at least one of said boreholes for said longitudinal tension unit are equally created in said monolithic upper plate, said side walls and said frame unit of each of said prismatic float modules, said axis of at least one of said boreholes oriented in different directions meet in said corner of said corners of each of said prismatic float modules and are being skew, a rigid spatial corner elements surround at least one of said boreholes at each of said corners of each of said prismatic float modules, said rigid spatial corner elements cover one of the plurality of said edges of each of said prismatic float modules, said corner elements are made of an impact resistance material with a compressive strength that exceeds a strength of each of said prismatic float modules, at least one of said boreholes of said corner elements being in coincidence with said exit holes of at least one of said boreholes, said directional recesses having a shape of a truncated cone tapering inwards are sunk into said corner elements, said directional spacers fit into said directional recesses, said directional spacers having a shape complementary to that of said directional recesses, a shape of two truncated cones, with bases facing each other, and wherein each said directional spacer is a body made of resilient material, said body of each said directional spacer forms two truncated cones, with said bases facing each other, and along the Tz axis at least one of said borehole passes through said longitudinal tension unit.

2. The structure of claim 1, wherein of at least one of said boreholes for said longitudinal tension unit are equally created in said upper plate, said side walls and said frame unit of each of said plurality of prismatic float modules and one of the plurality of said edges of said upper plate and said side walls meeting in said corner are covered by said corner element in each of said corners of each of said plurality of prismatic float modules.

3. The structure of claim 1, wherein a cone angle (ϕ) of said directional recess and each said directional spacer is at least 90°.

4. The structure of claim 1, wherein of each said plurality of said prismatic float modules is fixed by said longitudinal tension unit running parallel with said base and said upper plate of each of said plurality of said prismatic float modules and by said tension unit running perpendicular to said upper plate of each of said plurality of said prismatic float modules.

5. The structure of claim 1, wherein each of said prismatic float modules is fixed by an expansion fixing unit inserted into at least one of said boreholes created for said longitudinal tension unit.

6. A structure to connect float modules to each other for creating pontoons constructed of concrete float modules, comprising:

a plurality of prismatic float modules, each prismatic float module of the plurality of prismatic float modules including at least a monolithic upper plate, side walls and a frame unit arranged to form a plurality of edges of said each of said plurality of prismatic float modules, each of said prismatic float modules of the plurality of prismatic float modules fixed to at least one other prismatic float module of the plurality of prismatic float modules by means of a longitudinal tension unit led through said plurality of prismatic float modules in one of the boreholes created for said longitudinal tension unit in said monolithic upper plate of each of said prismatic float modules at least at one of the plurality of said edges of said monolithic upper plate of each of said prismatic float modules, intersecting each of said prismatic float modules and running parallel with one of the plurality of said edges, an axis of at least one of said boreholes oriented in different directions meet in one of corners of each of said prismatic float modules, and directional recesses are created around exit holes of at least one of said boreholes, into which a directional spacer is inserted between each of said prismatic float modules, each said directional spacer comprising at least one of said boreholes for letting through said longitudinal tension unit wherein at least one of said boreholes for said longitudinal tension unit are equally created in said monolithic upper plate, said side walls and said frame unit of each of said prismatic float modules, said axis of at least one of said boreholes oriented in different directions meet in said corner of said corners of each of said prismatic float modules and are being skew, a rigid spatial corner elements surround at least one of said boreholes at each of said corners of each of said prismatic float modules, said rigid spatial corner elements cover one of the plurality of said edges of each of said prismatic float modules, said corner elements are made of an impact resistance material with a compressive strength that exceeds the strength of each of said prismatic float modules, at least one of said boreholes of said corner elements being in coincidence with said exit holes of at least one of said boreholes, said directional recesses having the shape of a truncated cone tapering inwards are sunk into said corner elements, each said directional spacer fits into said directional recess, each said directional spacer having a shape complementary to that of each said directional recess, a shape of two truncated cones, with bases facing each other, and wherein each said directional spacer is inserted between two adjacent of said plurality of prismatic float modules, in a shape of two truncated cones, with said bases facing each other, and each said directional spacer is fastened into one of each said directional recess.

7. The structure of claim 6, wherein of at least one of said boreholes for said longitudinal tension unit are equally created in said upper plate, said side walls and said frame unit of each of said plurality of prismatic float modules and one of the plurality of said edges of said upper plate and said side walls meeting in said corner are covered by said corner element in each of said corners of each of said plurality of prismatic float modules.

8. The structure of claim 6, wherein a cone angle ($\phi$) of each said directional recess and said directional spacer is at least 90°.

9. The structure of claim 6, wherein of each said plurality of said prismatic float modules is fixed by said longitudinal tension unit running parallel with said base and said upper plate of each of said plurality of said prismatic float modules and by said tension unit running perpendicular to said upper plate of each of said plurality of said prismatic float modules.

10. The structure of claim 6, wherein each of said prismatic float modules is fixed by expansion fixing unit inserted into at least one of said boreholes created for said longitudinal tension unit.

* * * * *